United States Patent [19]

Plachy

[11] Patent Number: 4,490,935

[45] Date of Patent: Jan. 1, 1985

[54] PEN GUN

[76] Inventor: Joseph Plachy, 4103 NW. 19 St., Lauderhill, Fla. 33313

[21] Appl. No.: 468,987

[22] Filed: Feb. 23, 1983

Related U.S. Application Data

[63] Continuation-in-part of Ser. No. 203,615, Nov. 3, 1980, abandoned.

[51] Int. Cl.[3] ..... F41C 9/02

[52] U.S. Cl. ..... 42/1 J

[58] Field of Search ..... 42/1 J

[56] References Cited

U.S. PATENT DOCUMENTS 1,608,359 11/1926 Biason ..... 42/1 J
1,664,049 3/1928 Sedgley ..... 42/1 J
1,681,172 8/1928 Cocho ..... 42/1 J

FOREIGN PATENT DOCUMENTS 161334 4/1933 Switzerland ..... 42/1 J
390087 7/1965 Switzerland ..... 42/1 J

*Primary Examiner*—Charles T. Jordan
*Attorney, Agent, or Firm*—Malin, Haley & McHale

[57] ABSTRACT

A hand-held, single shot weapon having the aesthetic function and capabilities of a writing instrument such as a ballpoint pen which can be actuated by pulling axially an end tip member against spring tension to quickly fire the weapon. The weapon includes interconnected threadable end and central body portions which allow complete safety of the weapon while it is being carried.

3 Claims, 9 Drawing Figures

PEN GUN

BACKGROUND OF THE INVENTION

This is a continuation-in-part of U.S. patent application Ser. No. 203,615, filed Nov. 3, 1980, now abandoned.

This invention relates generally to a ball point pen which has a hidden chamber and mechanism for firing a single bullet. The purpose of the invention is to provide a writing instrument such as a ballpoint pen which can be carried conveniently on the person, used as a writing instrument, while at the same time providing emergency use as a weapon, if necessary.

Single shot concealed weapons have been known in the past. In U.S. Pat. No. 1,608,359 issued to Biason, a fountain pen is shown in conjunction with a single shot weapon. One of the drawbacks of the device is that it has exterior operative protrusions which definitely detract from its appearance as a fountain pen. Further the use of exterior protrusions to form triggers or other mechanical elements complicate the device and make it more expensive in manufacture. Finally, such devices are more complicated to operate for the user and require extreme dexterity in moments of emergency which may limit any use of the device. In another U.S. Pat. No. 1,664,049 issued to Sedgley on Mar. 27, 1928, Sedgley shows a firearm that appears as a pen, with no writing element. Another problem with Sedgley is again the use of mechanical trigger elements and locking elements which greatly increase the expense of the device, and reduce the operational speed of the operator to fire the device.

The present invention overcomes the problems of the prior art by providing a ballpoint writing instrument which is completely smooth on its exterior (except for the pocket clip) and which looks identical to a pen while, in fact, having a very simple but safe firing mechanism embodied therein.

SUMMARY OF THE INVENTION

This invention relates to a concealed weapon having the aesthetic appearance and functional capabilities of a ballpoint pen, which can be carried on a person in a pocket or the like. The invention is comprised of a body member made of a rigid material that is essentially elongated and cylindrical and has a hollow central passage, with one end having a threaded opening for engagement with one end piece of the device and a moveably, opposing end piece that in conjunction with a central tube actuates the weapon. The threaded end member includes a chamber area for receiving a single bullet and a barrel.

A moveable end tip is utilized that is tapered like a pen and has a hollow chamber for passage therethrough that receives the shaft and writing ball of a ballpoint pen. A central hollow tube receives the ballpoint shaft at one end and a firing pin in the opposite end. The tapered end that is grasped as a pen is spring loaded for longitudinal axial movement against the spring tension, and which when pulled out away from the central body pulls the firing pin, the central tube, and the writing shaft, causing the firing pin to be held away from the detonation point of the shell. Upon release, the firing pin will contact the detonation point on the shell with sufficient kinetic energy causing the gun to be fired.

The weapon cannot fire unless the end tip is pulled back a sufficient distance so that upon release, enough kinetic energy is generated when the pin strikes the shell.

The end tip adjacent the ball point mechanism can be rotated to expose or hide the ball point pen end as desired. This prevents ink from getting on clothing when the pen is not in use (in the hidden position).

It is an object of this invention to provide a safety weapon that can be carried on the person conveniently that has the aesthetic appearance and functional capabilities of a ballpoint pen.

It is another object of this invention to provide a concealable emergency weapon that can be safely carried but quickly actuated for emergency situations to provide firing of a single shell.

And yet still another object of this invention is to provide a low cost weapon useful for self defense which can be also used as a ballpoint pen, and does not require any exterior triggers or other complicated mechanisms for its actuation, or which could be accidentally set off.

In accordance with these and other objects which will be apparent hereinafter, the instant invention will now be described with particular reference to the accompanying drawings.

PREFERRED EMBODIMENT OF THE INVENTION

Figure 3:
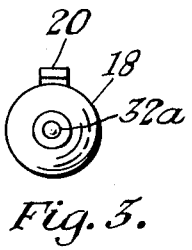
FIG. 3 shows an end elevational view showing the writing tip of the present invention.

Referring now to the drawings and especially FIGS. 1, 4 and 5 the present invention is shown generally at 10 comprised of a rigid tubular body 12 which is cylindrical and has a hollow sectioned chamber (discussed below) with end member 14, also cylindrical and somewhat tapered at one end, threadably attached to one end of the central body 12. At the opposite end two additional body sections are attached, segment 16 being slidably connected relative to body portion 12, and also being threadably connected to body segment 18. Body segment 18 is tapered for proper holding as a writing instrument such as a pen. A ballpoint pen tip 32*a* protrudes through the end segment 18 to allow for writing. A pocket clip 20 is connected by a band 20*a* affixed around the opposite end of the device. A removable end cap 22 hides the barrel chamber from view and is easily removable or installable.

Figure 1:
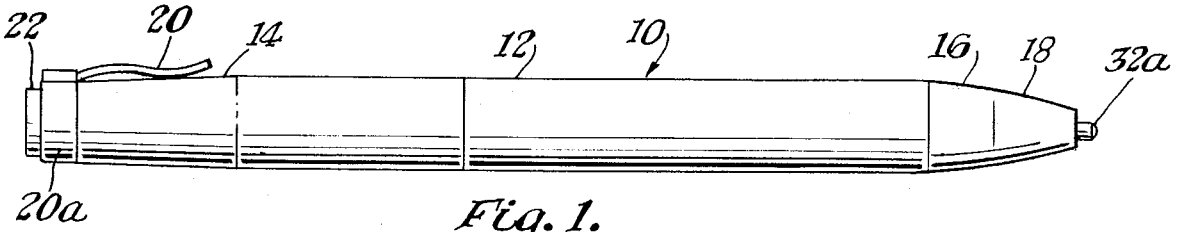
FIG. 1 shows a side elevational view of the present invention.
Figure 2:
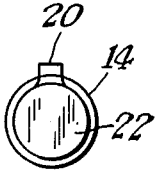
FIG. 2 shows an end elevational view showing the barrel end of the present invention.

As shown in FIG. 1 the overall aesthetic shape and appearance of the device is certainly that of a ballpoint pen. In this configuration the device is usable as a writing instrument. FIG. 2 shows the end cap cover 22 and the pocket clip 20 which adds further to the appearance of the device while allowing it to be firmly held in a pocket or the like.

FIG. 3 shows the opposite end view with the ball point pen tip 32*a* located along the axis of the device.

Figure 4:
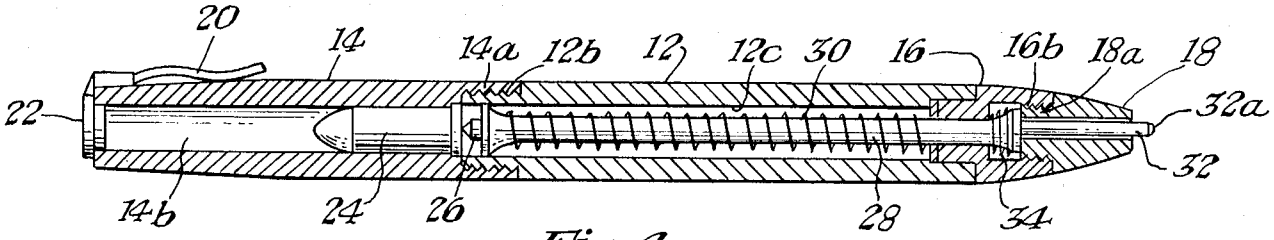
FIG. 4 shows a side elevational view in cross section showing the present invention in the nonfiring position.
Figure 5:
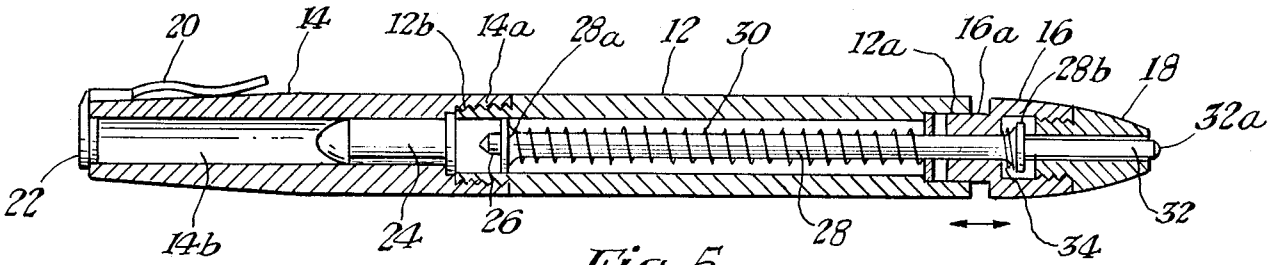
FIG. 5 shows a side elevational view in cross section showing the present invention in a firing position, with the end tip pulled back as it would be prior to release.

Referring now to FIGS. 4 and 5 the internal mechanism of the device is shown. The mid-body portion 12 includes a central passage 12*c* disposed from end to end, terminating toward the writing tip end in an enlarged smooth passage 12*a*. Intermediate section 16 includes a cylindrical wall section 16*a* that fits snuggly but movably into chamber 12*a*. Chamber 12*a* is larger in diameter than the central passage 12*c*.

Disposed at the opposite end (from the writing end) is the firing chamber comprised of body section 14 which includes a barrel 14*b* centrally disposed and as shown a bullet or shell 24 disposed in the firing chamber. Body segment 14 further includes a female threaded end portion 14*a* that fits over the threaded male end 12*b* extending from the central body portion 12. The threaded female connector 14*a* and male connector 12*b* allow the operator to remove end section 14 to insert a bullet and the removal of the shell. The caliber and size of the barrel 14*b* can be made conventional so that the device uses a conventional sized shell.

Disposed within the central body 12 is an elongated tube 28 that is flanged at each end 28*a* and 28*b* after it has been placed within the housing to allow interconnection with body segment 16. The flanged end 28*a* allows for retention at one end of the spring 30 and also for insertion of the firing pin 26 which firmly sits inside of tube 28. The amount of extension of the pin 26 will be a function of the proper dimensions to effect firing of the shell 24.

The writing end and the actuating mechanism is designed to include an intermediate segment 16 and a threaded end tip segment 18 connected thereto. The body segments 16 and 18 together comprise the actuating mechanism that fires the device. This is accomplished by pulling the unit back against springs 30 and 34. The spring 30 is pressed against an end stop at the end of the central chamber in body segment 12. This causes movement of tube 28 and firing pin 26 when the end tip 18 is pulled back against the spring tension. The female chamber 12*a* and the wall portion 16*a* of segment 16 slide relative to each other to allow the end tip to be pulled back against the spring action causing the firing pin 26 to strike the shell with sufficient kinetic energy to fire the device when released.

The end tip 18 can be rotated relative to body segment 16 (due to the threadable engagement between the threaded portion 18*a* and the female portion 16*b*) to cause the ballpoint tip 32*a* to either project outwardly from the end of the pen or to be disposed within the end tip 18. The ballpoint mechanism 32 itself includes a tube carrying ink which fits snuggly within tube 28 so that it runs along the length inside of tube 28, firmly holding the ballpoint mechanism 32 in place.

FIG. 5 shows the device when it is pulled back prior to release for firing shell 24. It is hand held in this position with the operator holding the center portion of the body 12 in on hand and the end tip 16 in the opposite hand. It can be seen that the operator need merely pull back and release to effect a quick firing.

Referring to FIGS. 6 through 9 an alternate and physical embodiment is shown therein. This embodiment is preferred because it is designed to handle and fire a rim-fire bullet or shell 24*a* as opposed to a center-fire bullet 24 of the embodiment in FIGS. 1–5. The mid-body portion 36 of this preferred embodiment includes an off-center longitudinal passage 36*b* for receiving and slidably holding firing pin 58. The firing pin 58 includes an enlarged recessed shell-striking end portion 58*a* fitted into a mating recess in the threaded end portion 36*a* of mid-body portion 36. The firing pin also includes an enlarged hammer-striking end portion 58*b* sufficiently large to prevent inadvertent loss of the firing pin 58 during disassembly, but sufficiently small to be forceably urgable into the passage 36*b*. As the hammer 38 strikes the firing pin at 58*b*, the firing pin at 58*a* is driven into the end of and detonates, the bullet 24*a*.

Still referring to FIGS. 6 through 9, hammer 38 includes enlarged bearing portion 38*a* which is sized to align and translate within the longitudinal cavity 36*d* in mid-body portion 36. The main hammer portion is sized to align and translate within a mating bearing hole 46*a* in a plug 46 threaded into position in the mid-body portion at 36*c*. Ballpoint pen 50 passes through a central longitudinal base through hammer 38. Longitudinal positioning and retention of the ballpoint pen 50 is accomplished by forceably urging the open end 50*b* into a mating pocket at the bottom of longitudinal cavity 36*d*. Spring 66, in compression presses between enlarged bearing portion 38*a* and plug 46. Near one end 38*b* of the hammber 38 is a snap ring 68 held by spring 66 compression force against the bottom of threaded portion of end tip segment 44, which segment is slidably positioned in end hole 36*e* in mid-body portion 36. Retainer 42 has threaded ends 42*a* and 42*c*, separated by reduced diameter smooth portion 42*b*. Threaded end portion 42*c* matably threads into end 44*a* of end tip segment 44 and serves to lock snap ring 68, and consequently the hammer relative to end tip segment 44. The other end 42*a* threadably mates within end tip 40 which provides the finish contour of the writing end of the invention as well as providing the exit opening for the ballpoint tip 50*a*. End tip 40 also includes an internal cavity 40*b* having an annular portion 40*a* which receives and laterally positions an O-ring 48 snuggly positioned around smooth portion 42*b*. The O-ring provides friction resistance to retain end tip 40 in any position relative to the extension of the ball pen tip 50*a* beyond the holed end of the end tip 40. This positioning in the direction of the arrow of end tip 40 relative to ball pen tip 50*a* is accomplished by rotating the end tip 40 on the threaded end 42*a* of retainer 42 relative to the rest of the pen-gun.

Figure 7:
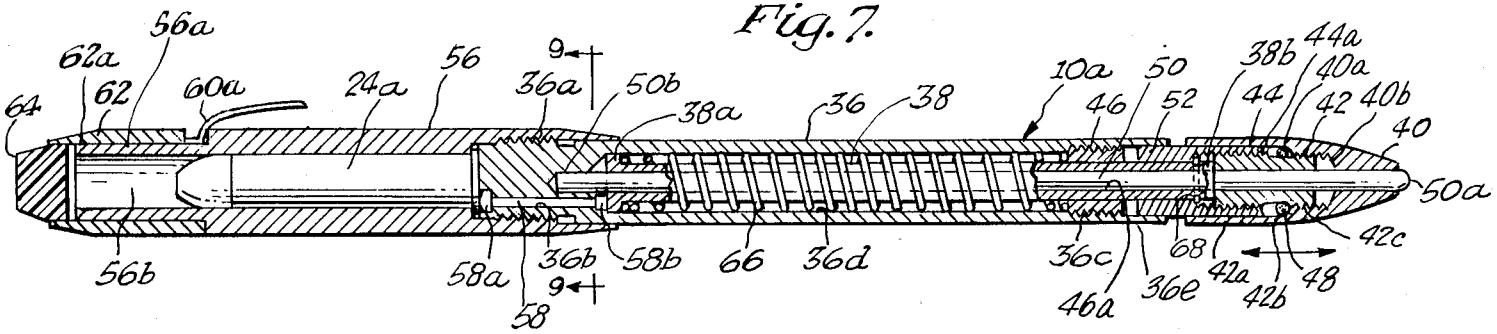
FIG. 7 shows a side elevation view in partial cross section through 7—7 in FIG. 6.
Figure 6:
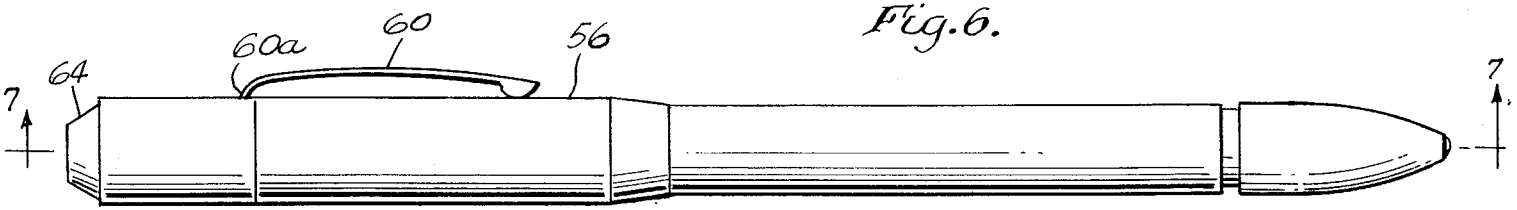
FIG. 6 shows a side elevation view of an alternate and preferred embodiment of the invention.
Figure 8:
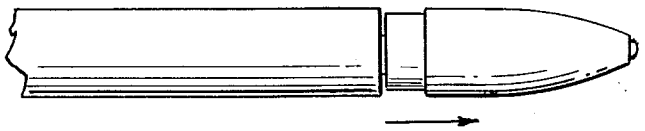
FIG. 8 shows the embodiment in FIG. 6 ready for firing.
Figure 9:
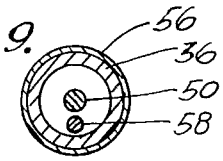
FIG. 9 is a section view through 9—9 in FIG. 7.

Firing the embodiment in FIGS. 6 and 7 is similar to the previously discussed embodiment. End tip 40 is grasped and drawn away from mid-body portion 36 a suitable distance then released when barrel 56 is appropriately aimed. To load this pen-gun, the bullet 24*a* is placed into the barrel as shown, after which the barrel is tightly threaded onto the externally threaded end 36*a* of mid-body portion 36 against the flanged end of the bullet as shown. A removable end cap 64, removable or installable in end cap portion 62, form the bullet-concealing contour of the pen-gun. End cap portion 62 is forceably urgable at 62*a* onto the barrel end. A pocket clip 60 is connected by a band or otherwise affixed to the device as shown.

As can be seen from the structure of the device, although functional as a pen, the device can be carried on the person, without an accidental misfiring. The only way the device can be fired is by pulling back far enough on the end tip to achieve enough kinetic energy to detonate the bullet 24 or 24'.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. In combination, a writing instrument and a hand-held single shot gun, the combination comprising:

a central cylindrical body member having a passage disposed along at least a portion of its longitudinal central axis;

a first end member having a threaded end portion threadably connectable to one end of said central body member, said first end member having a firing chamber for a single shell and a barrel centrally disposed therethrough;

a second end member disposed at the other end of said central body member, said second end member slidably connected to said central body member, said second end member having a central passage disposed therethrough;

a central shaft connected within said second end member;

firing pin means disposed at one end of said central shaft;

said central shaft also disposed in said passage in said central body member;

means for tensioning said central shaft and said second end member relative to said central body member; and a writing means disposed within said central shaft;

said second end member including an intermediate body portion and an end tip portion threadably connected to said intermediate body portion;

said intermediate body portion and said end tip portion rotatable relative to one another to expose said writing means in a first position or to hide said writing means in a second position.

2. In combination, a writing instrument and a hand-held single shot gun, the combination comprising:

a central cylindrical body member having a passage disposed along its longitudinal central axis therethrough from end to end;

a first end member having a threaded end portion threadably connectable to one end of said central body member, said first end member having a firing chamber for a single shell and a barrel centrally disposed therethrough;

a second end member disposed at the other end of said central body member, said second end member slidably connected to said central body member, said second end member having a central passage disposed therethrough;

a central shaft connected within said second end member, said central shaft having a firing pin disposed at one end;

said central shaft also disposed in said passage in said central body member;

means for tensioning said central shaft and said second end member relative to said central body member; and a writing means disposed through said second end member and connected to said central shaft;

said second end member including an intermediate body portion and an end tip portion threadably connected to said intermediate body portion;

said intermediate body portion and said end tip portion rotatable relative to one another to expose said writing means in a first position or to hide said writing means in a second position.

3. In combination, a writing instrument and a hand-held single shot gun, the combination comprising:

a central cylindrical body member having a cavity disposed along substantially all of its longitudinal central axis;

a first end member having a threaded end portion threadably connectable to one end of said central body member, said first end member having a firing chamber for a single rim fire shell and a barrel centrally disposed therethrough;

a second end member disposed at the other end of said central body member, said second end member slidably connected to said central body member, said second end member having a central passage disposed therethrough;

a central shaft having a first end connected within said second end member, said central shaft having a bearing hammber portion disposed at the other end;

said central shaft also disposed in said passage in said central body member;

said bearing hammer portion slidably connected in said central body member;

means for tensioning said central shaft and said second end member relative to said central body member; and a writing means disposed through said second end member and said central shaft and connected at the bottom of said cavity in said central body member;

said bottom of said caavity including a slidably mounted firing pin held for impact translation by said bearing hammer portion of said central shaft;

said firing pin longitudinal axis spaced apart from that of said gun sufficiently to align said firing pin with the detonation area of said rim fire shell;

said second end member including an intermediate body portion and an end tip portion threadably connected to said intermediate body portion;

said intermediate body portion and said end tip portion rotatable relative to one another to expose said writing means in a first position or to hide said writing means in a second position.

* * * * *